US006874214B1

(12) United States Patent
Fader et al.

(10) Patent No.: US 6,874,214 B1
(45) Date of Patent: Apr. 5, 2005

(54) ANTI-CORROSION COATING APPLIED DURING SHOT PEENING PROCESS

(75) Inventors: Joe Fader, Brighton, MI (US); Chris Keeney, Troy, MI (US); Jim Hawkins, Madison, AL (US); Mark Clements, Lapeer, MI (US); Steve Yollick, Troy, MI (US)

(73) Assignee: Meritor Suspension Systems Company, Ontario (CA)

( * ) Notice: Subject to any disclaimer, the term of this patent is extended or adjusted under 35 U.S.C. 154(b) by 524 days.

(21) Appl. No.: 09/584,032

(22) Filed: May 30, 2000

(51) Int. Cl.[7] ..... B23P 25/00

(52) U.S. Cl. ..... 29/90.7; 29/458; 29/527.2; 72/53; 427/180

(58) Field of Search ..... 29/90.7, 458, 527.2; 72/53; 427/180, 201

(56) References Cited

U.S. PATENT DOCUMENTS

| | | | | |
|---|---|---|---|---|
| 2,788,297 A | * | 4/1957 | Louis | 427/180 |
| 3,754,976 A | * | 8/1973 | Babecki et al. | 29/527.2 |
| 3,950,642 A | | 4/1976 | Feld | |
| 4,329,862 A | | 5/1982 | Harburn et al. | |
| 4,604,881 A | * | 8/1986 | Lienert | 72/53 |
| 4,687,556 A | | 8/1987 | Sutton et al. | |
| 4,909,859 A | | 3/1990 | Nazmy et al. | |
| 5,019,182 A | | 5/1991 | Arimi | |
| 5,515,707 A | | 5/1996 | Smith | |
| 5,816,088 A | | 10/1998 | Yamada et al. | |

FOREIGN PATENT DOCUMENTS

| | | |
|---|---|---|
| EP | 0 488 353 A | 6/1992 |
| EP | 0 556 065 A | 8/1993 |
| EP | 0 647 505 A | 4/1995 |
| GB | 1 041 620 A | 9/1966 |
| GB | 2 182 352 A | 5/1987 |
| JP | 03 184770 A | 8/1991 |
| JP | 04 036486 A | 2/1992 |

OTHER PUBLICATIONS

European search report, dated Sep. 2, 2003.

* cited by examiner

*Primary Examiner*—David P. Bryant
*Assistant Examiner*—Jermie E. Cozart
(74) *Attorney, Agent, or Firm*—Carlson, Gaskey & Olds

(57) ABSTRACT

A sacrificial metal coating to resist corrosion is deposited onto a vehicle component during a shot peening operation. Since the deposition occurs during the shot peening operation, a separate coating step is not necessary. Preferably, the component is a vehicle suspension component.

16 Claims, 2 Drawing Sheets

ANTI-CORROSION COATING APPLIED DURING SHOT PEENING PROCESS

BACKGROUND OF THE INVENTION

This invention relates to a method of depositing an anti-corrosion material onto a surface subject to corrosion, wherein the deposition of the coating is performed during a shot peening process.

Many vehicle components are subject to corrosion, since they are exposed to the environment. In particular, components mounted under the frame of a vehicle are exposed to a harsh environment. Examples include components of the suspension systems for vehicles, which have typically been subject to corrosion. To prevent corrosion, springs, stabilizer bars, torsion bars and other components of the suspension have often been coated with sacrificial metal coatings to increase resistance to corrosion. However, the requirement of an additional coating process is relatively expensive.

Shot peening operations are often performed on the same components which are subject to corrosion. In a shot peening process, metal particles, which are typically steel, are thrown with force against a part to be treated. The shot peened particles harden the outer surface of the part.

In this invention, the deposition of a corrosion resistant coating is performed in conjunction with the shot peening process. Thus, the corrosion resistant coating can be applied with little added cost.

SUMMARY OF THE INVENTION

In a disclosed embodiment of this invention, a sacrificial metal coating which resists corrosion is applied to the outer surface of a shot peen particle. The shot peen particle impacts the surface of the part to be treated. Some of the coating remains with the part. At the conclusion of the shot peening process, the sacrificial metal cover the outer surface of the part. This process thus does not require any additional steps for depositing the coating, but instead deposits the coating during the shot peening process that the part must undergo.

In one method, the steel particles from the shot peening chamber are returned through a bath where the coating is deposited onto the particles. The particles are continuously circulated into the shot peening chamber, gathered, coated and returned.

In another embodiment, the shot peen particles could be formed entirely of the sacrificial metal. Of course, a metal which is sufficiently hard to perform the hardening function of the shot peening would be necessary. However, a worker of ordinary skill in this art would be able to select an appropriate alloy for not only depositing the sacrificial metal, but also for performing the shot peening function.

An automotive component within this invention is preferably a component on a vehicle, and more preferably a suspension component. Specific examples would include springs, stabilizer bars, torsion bars, etc. The finished coated component may be somewhat distinct from an otherwise coated part in that the coating may not be of a uniform thickness. That is, since the coating layer is deposited by the inventive shot peening process, rather than a standard coating process the coating, may not be of a uniform thickness, but may be of a more random thickness. The entire outer surface of the component should still be covered.

These and other features of the present invention can be best understood from the following specification and drawings, the following of which is a brief description.

DETAILED DESCRIPTION OF A PREFERRED EMBODIMENT

Figure 1:
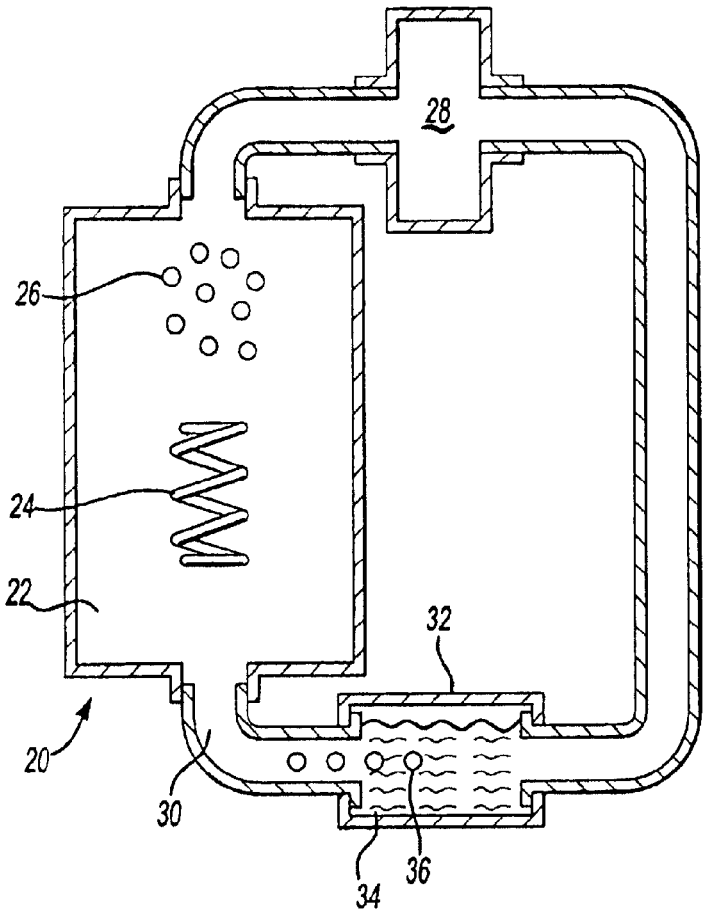
FIG. 1 is a schematic view of a shot peening process incorporating the present invention.

FIG. 1 shows a shot peening system 20 incorporating a shot peening chamber 22 receiving a component 24, here a spring for a vehicle suspension. As is known, shot peen particles 26 are injected into the chamber 22, and impact on the component 24, to plastically deform through indentation which thereby hardens its outer surface. While a spring is shown as the part to be shot peened in this invention, other suspension components such as torsion or stabilizer bars, and other vehicle components, may also benefit from this invention. In fact, the invention has benefits in the treatment of any part which requires shot peening, and which may also be subject to corrosion. As known, a system 28 impacts particles 26 against the part 24. Further, a return line 30 returns the particles 26 from the chamber 22 back to a delivery system 28. In the present invention, a coating bath 32 filled with a coating material 34 is placed between the return line 30 and the system 28. As shown, particles 36 are being coated by the coating material 34.

The coating material 34 is preferably a material which will be deposited on component 24, and which provides a sacrificial metal coating to resist corrosion of the component 24. Examples of such materials are cadmium, zinc, or zinc alloys. Typically component 24 is made of steel, and these coating materials provide a good sacrificial metal resistance to corrosion of the underlying steel component 24. Other known sacrificial metal coatings come within the scope of this invention.

Figure 2:
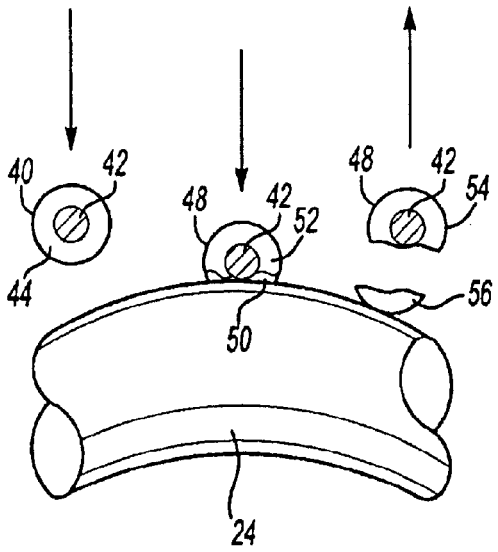
FIG. 2 is a view of the coating process in a first embodiment of this invention.

FIG. 2 illustrates the coating process according to the present invention. As shown, a first particle 40 has an underlying steel portion 42 surrounded by the sacrificial metal coating 44. Particle 40 is directed towards the outer surface 46 of the part 24. Another particle 48 also has the central portion 42, and has now contacted the outer surface 46. As can be seen, a portion 48 of the coating will remain with portion 42, and a portion 50 of the coating has impacted the surface 46. Another particle 54 has previously impacted the outer surface 46 and is moving away from the part 24 to be returned to the return line 30. As shown, the portion 48 of the coating remains with steel particles 42 while portion 56 remains on the part 24. It should be understood that the figures have been prepared to illustrate this invention. In fact, the thickness of the coating layer relative to the underlying portion may be smaller. The coating thickness should not be too great, as this could affect the shot peening function.

As will be appreciated the shot peening operation is controlled to cover the entire outer surface of the part. The shot peening operation may not systematically direct balls at each area, but rather directs a sufficient number of balls at the part that statistically the entire surface of the part will be shot peened. That is, the part as a whole is subjected to a volume of balls for a time period that the provides a high confidence that the entire outer surface will be effectively shot peened, however, as the balls are not specifically controlled along the outer surface, no absolute assurance is provided that every unit area of the outer surface will shot peened to an equivalent extent. Similarly, the shot peening operation will thus ensure that the great majority of the outer surface of the part will be coated by the sacrificial metal coating 56. The part 24 coated in this manner could be said to differ from the prior coated parts in that the coating may not be of a uniform thickness. That is, dependent on the impact angle, and the number of impacts at any one portion of the outer surface, etc. the thickness of the coating may vary across the outer surface of the part 24.

Figure 3:
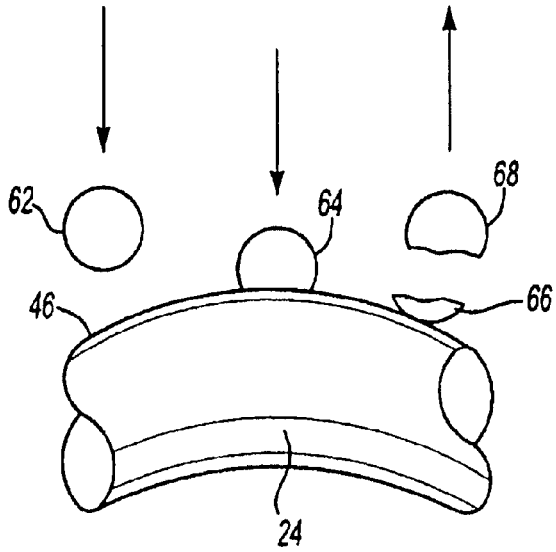
FIG. 3 is a view of a second embodiment coating processing.

FIG. 3 shows another embodiment wherein the particles 62, 64 and 68 are formed entirely of the sacrificial metal. As an example, an appropriate zinc alloy may be utilized. Such an alloy would need to be sufficiently hard that it will perform the shot peening function, but must also provide the sacrificial metal function.

The particle 62 is being directed at the outer surface 46, the particle 64 is impacting the outer surface 46 and the particle 68 has previously impacted and has rebounded away leaving a portion 66 on the outer surface 46. With the FIG. 3 embodiment, it may be that the particles 68 which are gathered and returned to the system 28 could also pass through a bath where they are recoated by their particular alloy. Alternatively, the balls may be continuously reused without coating and become smaller.

Figure 4:
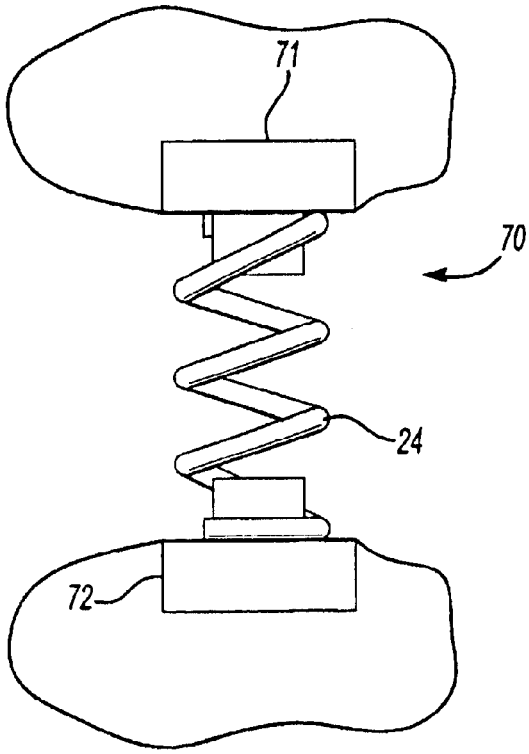
FIG. 4 schematically shows the mounting of a coated component into a vehicle.

FIG. 4 shows a suspension arrangement 70. A first component 71 is connected to a second component 72. A spring 24, which has been coated by the inventive process interconnects the two components 71 and 72. It should be understood, the components 71 and 72 are shown schematically, but are preferably portions of a vehicle. As is known, portion 72 may move during operation of a vehicle relative to portion 71, and spring 24 thus provides a suspension function during this movement. Again, while a spring has been disclosed, and while this figure schematically shows one arrangement, it should be understood that any suspension component, and more broadly, any vehicle component which may be subject to corrosion would benefit from this invention.

Preferred embodiments of this invention have been disclosed; however, a worker of ordinary skill in this art would recognize that certain modifications would come within the scope of this invention. For that reason, the following claims should be studied to determine the true scope and content of this invention.

What is claimed is:

1. A method of treating an outer surface of a component comprising the steps of:

(1) providing a component in a shot peening chamber;

(2) providing shot peening particles comprising an outer surface surrounded by a sacrificial metal coating selected to provide sacrificial metal corrosion resistance to said component; and (3) directing said shot peening particles against said component, and transferring a deposited coating of said sacrificial metal coating from said shot peening particles onto an outer surface of said component.

2. A method as set forth in claim 1, wherein said component is mounted onto a vehicle after step 3.

3. A method as set forth in claim 1, wherein said shot peening particles are returned through a bath of sacrificial metal coating after step 3.

4. A method as set forth in claim 3, wherein said shot peening particles have an underlying core of a first material which is distinct from said sacrificial metal coating.

5. A method as set forth in claim 1, wherein said shot peening particles are formed entirely of said sacrificial metal coating.

6. A method as set forth in claim 1, wherein said sacrificial metal coating is cadmium.

7. A method as set forth in claim 1, wherein said sacrificial metal coating includes zinc.

8. A method as set forth in claim 7, wherein said sacrificial metal coating is a zinc alloy.

9. A method as set forth in claim 1, wherein said component is a vehicle suspension component.

10. A method as set forth in claim 1, wherein said deposited coating has a non-uniform thickness across an outer peripheral surface of said component.

11. A method as set forth in claim 1 wherein the shot peening particles are directed with a velocity great enough to indent said outer surface of said component.

12. A method of treating an outer surface of a component comprising the steps of:

(1) providing a component in a shot peening chamber;

(2) providing shot peening particles having an outer surface surrounded by a sacrificial metal coating selected to provide sacrificial metal corrosion resistance to said component; and (3) directing said shot peening particles against said component at a velocity to indent an outer surface of said component and transfer said sacrificial metal coating from said shot peeing particles as a deposited coating on said component.

13. A method as set forth in claim 12, wherein said shot peening particles have an underlying core of a first material which is distinct from said sacrificial metal coating.

14. A method as set forth in claim 12, wherein said shot peening particles are formed entirely of said sacrificial metal coating.

15. A method as set forth in claim 12, wherein said deposited coating has a non-uniform thickness across an outer peripheral surface of said part.

16. A method as set forth in claim 12, wherein said component is metallic.

* * * * *